US005401928A

United States Patent [19]

Kelley

[11] Patent Number: 5,401,928

[45] Date of Patent: Mar. 28, 1995

[54] SAFETY CONTROL FOR POWER TOOL

[76] Inventor: William J. Kelley, 12302 S. 14th St., Jenks, Okla. 74037

[21] Appl. No.: 72,049

[22] Filed: Jun. 7, 1993

[51] Int. Cl.[6] ..... H01H 13/02

[52] U.S. Cl. ..... 200/510; 200/522

[58] Field of Search ..... 200/509, 510, 522

[56] References Cited

U.S. PATENT DOCUMENTS

| | | | |
|---|---|---|---|
| 2,928,921 | 3/1960 | Cranmore | 200/509 |
| 3,117,206 | 1/1964 | Bush | 200/510 |
| 3,869,690 | 3/1975 | Hickling | 200/509 X |
| 4,523,065 | 6/1985 | Heggelund | 200/509 |
| 4,667,119 | 5/1987 | Holmes | 200/509 X |

*Primary Examiner*—Renee S. Luebke
*Attorney, Agent, or Firm*—Roy A. Ekstrand

[57] ABSTRACT

A safety control for power tool includes a trigger responsive element coupled to the power tool drive apparatus. The trigger responsive element is operative to permit normal trigger movement between on and off positions. In addition, the trigger responsive element responds to excessive force upon the trigger in the on position to initiate a safety shutdown of the power tool drive apparatus. Upon release, the trigger responsive element returns the trigger to the off position without reactivating the power tool drive apparatus. Embodiments are shown for both electrical and internal combustion engine powered tools.

5 Claims, 3 Drawing Sheets

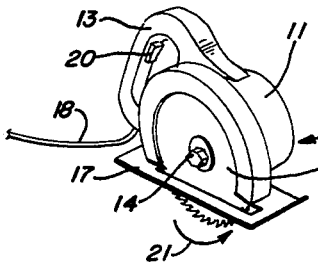
FIG. 1
FIG. 2A
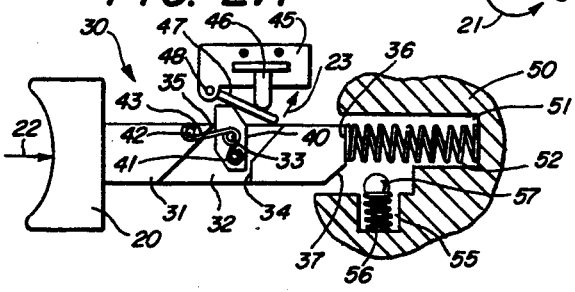
FIG. 2B
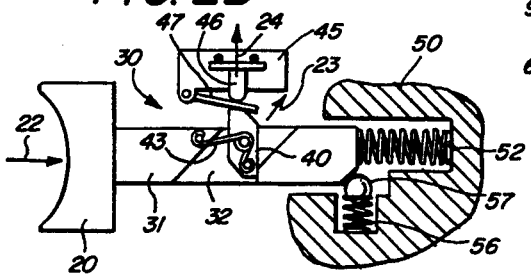
FIG. 2C
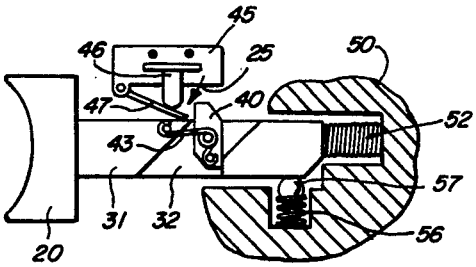
FIG. 2D
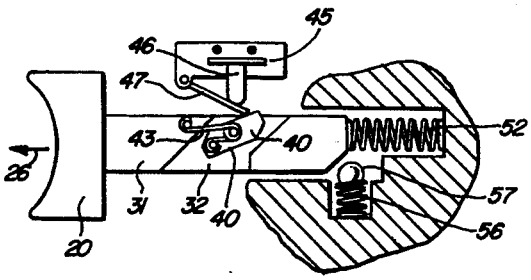
FIG. 3A
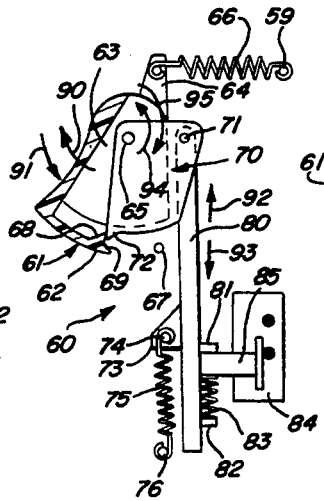
FIG. 3B
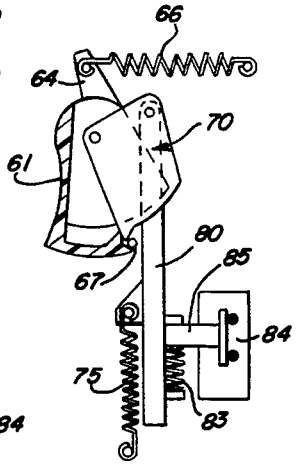
FIG. 3C
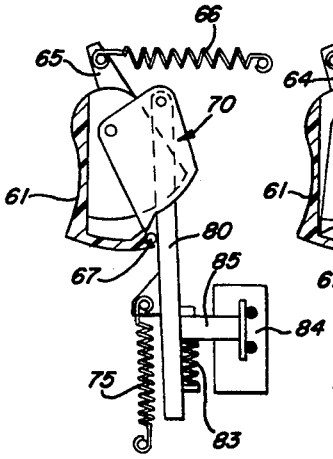
FIG. 3D
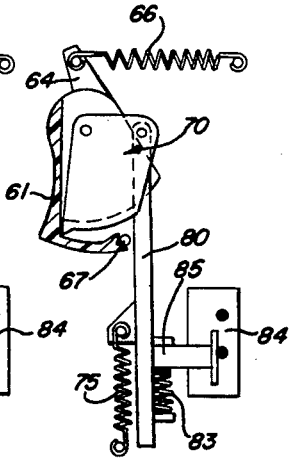

SAFETY CONTROL FOR POWER TOOL

FIELD OF THE INVENTION

This invention relates generally to power tool controls and particularly to safety apparatus for use in connection therewith.

BACKGROUND OF THE INVENTION

A great variety of handheld power tools have been created by practitioners in the art through the years. These extremely practical and helpful power tools have included circular saws, drills, reciprocating saws, chain saws and the like. A great number of such power tools are electrically powered having integral electric motors which are powered either by battery power sources within the power tool or through electrical connection to a conventional AC power source. Other types of power tools are operated using small gasoline engines. In most, if not all, of such power tools whether electrically or gasoline engine powered, a squeeze type control usually a squeezable trigger is used to control the power tool. In the most common type of arrangement, a movable trigger is supported within or proximate to one of the handle grips used by the operator in manipulating the power tool.

Such power tools provide great advantage in that they are largely or completely portable and thus are often available for use in otherwise difficult situations or environments. In many instances, however, the portability of such power tools and their flexibility of use in challenging environments often leads to substantial safety risks in that the operators of such tools often employ their use in somewhat precarious circumstances such as reaching high overhead or reaching laterally an extending distance to achieve a difficult objective.

In such extended or precarious circumstances, a substantial safety risk arises in that the natural human reflex when slipping or falling or losing balance in such precarious positions leads the operator to squeeze and grip the handle or handles of the power tool harder than usual. In many instances, operators subjected to falling or slipping actually instinctively lock onto the handle including the trigger actuator in a "death grip" type reflex action in which great force is applied to the trigger mechanism. As a result of this tendency or reflex, operators in precarious situations actually increase the risk of injury by such reflex gripping in that the power tool is then thrust into maximum operation adding the danger of a fully energized or fully operating power tool to an already dangerous situation. One can readily see that a risk of falling while itself is potentially dangerous, the potential for serious injury is greatly increased if the operator is holding a tool such as a chain saw, circular saw or reciprocating saw operating at full speed.

Practitioners in the art have recognized a variety of injury potentials within such power tools and have generally attempted to render such power tools safer to operate. For example, U.S. Pat. No. 3,873,796 issued to Worobec, Jr. sets forth a TRIGGER MECHANISM FOR HAND OPERATED POWER DEVICE INCLUDING INDEPENDENTLY OPERABLE LOCKING DEVICES PROVIDING AUTOMATIC LOCK OFF AND MANUAL LOCK ON OPERATION in which a trigger mechanism for hand operated power tool includes a manually operable trigger movable between inoperative and operable positions. A manually operable locking device automatically locks the trigger in its inoperative position and permits the trigger to be manually unlocked for movement between its inoperative and operative positions. A second manually operable locking device permits the trigger to be locked in its operative position.

U.S. Pat. No. 3,854,020 issued to Glover, et al. sets forth a TRIGGER MECHANISM FOR HAND OPERATED POWER DEVICE INCLUDING STATIONARY LOCKING DEVICE WHICH PROVIDES LOCK OFF AND LOCK ON OPERATION in which a trigger mechanism for hand operated power tool includes a manually operable trigger movable between inoperative and operative levels and a stationary locking device which normally locks the trigger in its inoperative level and which permits the trigger to be locked in its operative level.

U.S. Pat. No. 4,006,334 issued to Robotham, et al. sets forth a SAFETY SWITCH FOR POWER TOOL in which a switch and cooperating switch actuating element assure that the switch cannot be moved unless the actuating element is first manipulated through right angle motions in a predetermined sequence. The actuating elements carries a latch which normally holds it in the switch off position. The latch must first be moved laterally against the force of a biasing spring and held to release the actuating element.

U.S. Pat. No. 4,258,368 issued to Arnold, et al. sets forth SAFETY MEANS FOR PREVENTING THE AUTOMATIC RESTART OF A MOTOR in which a control system includes a thyristor switch such as a triac. Upon deenergization of the motor, the thyristor switch switches to its nonconductive state thereby preventing automatic restarting of the motor upon the restoration of power.

U.S. Pat. No. 4,451,865 issued to Warner, et al. sets forth an ELECTRICAL CUT-OUT FOR UNDER-VOLTAGE OR POWER LOSS CONDITIONS in which a safety feature within a tool or appliance or other electrically operated device is configured to require that the trigger or on/off switch be returned to the off position before the tool will respond to placing the trigger or on/off position in the on position.

U.S. Pat. No. 3,886,658 issued to Wikoff sets forth a HANDHELD POWER SAW having a safety handle which incorporates a safety switch disposed in a plane transverse to the plane of the power saw's blade. A main handle incorporates an on/off switch and is disposed in the plane of the saw blade. The safety handle comprises a hand grip of generally arcuate configuration that defines an arc of at least ninety degrees and a trigger member which extends along the hand grip's length and is pivotally connected at one end thereto. A switch carried in the hand grip electrically connects the trigger with the saw's power source.

U.S. Pat. No. 4,739,435 issued to Nothofer sets forth a SAFETY DEVICE FOR AN ELECTRIC POWER TOOL having a main switch, electronic controls and a tachometer/generator and a relay. The relay electrically parallels the motor and is activated through the tachometer generator and a safety circuit. Means are provided for switching the motor off at excessively high speeds to avoid overspeed of the power tool.

U.S. Pat. No. 4,794,273 issued to McCullough, et al. sets forth an ON/OFF CONTROL SYSTEM FOR POWER OPERATED HAND TOOLS in which the hand tool is driven by an electric motor, flexible shaft or a source of pressurized air through a supply line. A low power frequency is applied alternately to the hand tool and the supply line while appropriate circuitry detects changes in the frequency of applied signal caused by the operator grasping the hand tool or power supply line.

U.S. Pat. No. 4,839,533 issued to Aga sets forth a REMOTE SAFETY SWITCH in which a foot operated safety switch preferably including an electronic control reset circuit is connected between a source of electrical current and the power cord of an electrically operated device having an on/off switch of its own.

U.S. Pat. No. 4,964,558 issued to Crutcher, et al. sets forth an ELECTROMECHANICAL FASTENER DRIVING TOOL in which a power operated automatic nailing machine or the like includes an elongated handle having a trigger switch and a separate safety switch both controlling the operation of the power nailer.

U.S. Pat. No. 4,970,355 issued to Haeusslein, et al. sets forth a SAFETY DEVICE IN AN ELECTRICALLY POWERED MACHINE ESPECIALLY A HANDHELD POWER TOOL in which a source of electrical energy is controlled by an on/off switch. A switch handle is provided for operating the switch to control delivery of electrical energy to the active mechanism. A stop pawl is provided which prevents the connection of the electrical plug to the machine so long as the on/off switch is in the on position thus preventing an unintentional start up of the tool.

U.S. Pat. No. 5,094,000 issued to Becht, et al. sets forth a HANDHELD POWER TOOL WITH A ROTARY DRIVEN TOOL in which a common housing supports a rotary driven tool and a trigger actuated brake element.

U.S. Pat. No. 5,105,130 issued to Barker, et al. sets forth a KEYBOARD CONTROLLED MULTIFUNCTION POWER TOOL WITH VISUAL DISPLAY in which a multifunction handheld power tool includes an electric motor for driving a tool holder and control means for energizing the motor. A keyboard supported on the housing is used to input a combination of instruction conditions to the control mechanism.

U.S. Pat. No. 5,172,522 issued to Jares sets forth a HANDLE USED ON A HANDHELD GRINDER OR BUFFER in which a generally u-shaped handle is coupled to the head portion of a buffer or grinder to provide additional hand control of the tool.

U.S. Pat. No. 4,617,501 issued to Smith sets forth a CONTROL AND SAFETY SYSTEM FOR ELECTRICALLY POWERED SUBMERSIBLE TOOLS AND LIGHTS in which a control system includes a relay for connecting and disconnecting the external AC power source from the system and a transformer connected to the relay for transforming the AC power to a desired lower voltage together with a converter connected to the transformer for converting the transformed AC to DC power.

U.S. Pat. No. 3,646,298 issued to Weber, et al. sets forth a SWITCH OPERATING TRIGGER WITH INTEGRAL BIASING MEANS AND EXCESSIVE FORCE PROTECTION MEANS in which a grass trimmer having an electric motor, a rotary blade, a handle extending from the motor and a trigger switch on the grip portion of the handle is described. The trigger switch includes an on/off switch for applying power to the motor and a trigger member. Integral with the trigger member is a resilient extension which abuts a fixed surface in the handle to provide a force biasing the trigger in the off direction to provide an improved "feel" for the operator and avoid a "hair trigger characteristic".

While the foregoing described prior art devices have added to the safety of many power tools in operation, they have failed to address the need described above in rendering power tools safer in operation during the reflex locking or gripping circumstances. There remains, therefore, a need in the art for ever safer and more risk free power tool control systems.

SUMMARY OF THE INVENTION

Accordingly, it is a general object of the present invention to provide an improved power tool control system. It is a more particular object of the present invention to provide an improved power tool control system which responds to the problems of reflex grip triggering on the part of power tool users.

In accordance with the present invention, there is provided for use in controlling a power tool having drive means and a movable control member movable in a first direction between an off position and an on position to activate the power tool and in a second direction between the on position and off position to deactivate the power tool, a safety control comprises: first means for responding to control member movement in the first direction beyond the on position to a shutdown position to deactivate the power tool; and second means responsive to control member movement in the second direction from the shutdown position to the off position for maintaining the deactivation of the power tool notwithstanding control member movement through the on position.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 1 sets forth a perspective view of a circular saw power tool having the present invention safety control;

FIGS. 2A through 2D taken together set forth the operation of a safety control for power tool constructed in accordance with the present invention;

FIGS. 3A through 3D taken together set forth the sequence of operation of an alternate embodiment of the present invention safety control;

DESCRIPTION OF THE PREFERRED EMBODIMENTS

Figure 4:
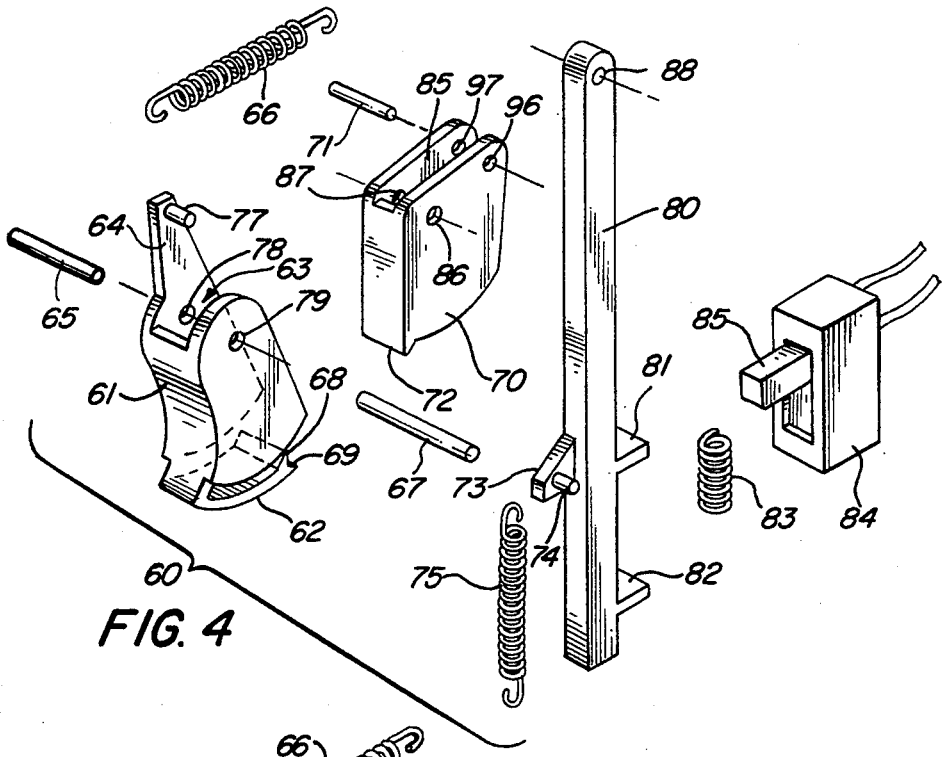
FIG. 4 sets forth a perspective assembly view of the embodiment of the present invention set forth in FIGS. 3A through 3D.

FIG. 1 sets forth a perspective view of a circular saw power tool generally referenced by numeral 10 having a safety control constructed in accordance with the present invention. In accordance with conventional fabrication techniques, circular saw 10 includes a motor housing 11 supporting an electrical motor therein (not shown) having a power shaft 14 extending outwardly therefrom. A circular saw blade 16 is operatively coupled to power shaft 14. A generally planar saw guide 17 is secured to housing 11 and receives a portion of saw blade 16. Housing 11 further includes a generally U-shaped handle 13 having a depressible trigger 20 used for on/off actuation of circular saw 10. A conventional power cord extends outwardly from housing 11 and includes conventional connecting plug apparatus (not shown) used to couple circular saw 10 to a source of alternating current power.

In operation, the user grasps handle 13 such that at least one finger overlies trigger 20. Thereafter, the user positions circular saw 10 such that the exposed portion of saw blade 16 extending beyond guide 17 is positioned at the desired cut position. Thereafter, the user squeezes trigger 20 to operate the switch mechanism set forth below in FIG. 2A to energize the circular saw motor and produce rotation of saw blade 16 in the direction indicated by arrow 21. Under normal operating conditions, the simple depression of trigger 20 provides energizing of circular saw 10 and rotation of saw blade 16. In the event, however, the user employs circular saw 10 in an situation in which a sudden reflex action is produced which causes a reflex locking grip upon handle 13 and the squeezing of trigger 20, the present invention safety control is activated to interrupt electrical power to circular saw 10 and deenergize the motor thereby avoiding further injury. This interruption of power persists no matter how long or hard the user maintains a reflex grip upon trigger 20 and handle 13. Once the user realizes the reflex gripping which has occurred and releases trigger 20, the present invention safety control is operative in accordance with the sequence set forth below to return the switch condition of circular saw 10 to the off position without passing through an on position or energized condition for saw 10.

Thus, in accordance with an important aspect of the present invention and in the manner set forth below in greater detail, the present invention safety control shuts off the power tool (in this case circular saw 10) once the user exerts a greater than normal force upon the trigger actuator. In further accordance with an important aspect of the present invention also set forth below, the release of the trigger actuator causes the safety control within the present invention system to return to a reset off condition without passing through any activation or on position for the power tool switch control.

FIGS. 2A through 2D set forth the safety control mechanism of the present invention and the operational sequence thereof in the manner described in conjunction with FIG. 1. Thus, by way of overview, FIG. 2A sets forth the present invention safety control in the reset or normally off position prior to operation. FIG. 2B sets forth the normal on position of the present invention safety control while FIG. 2C sets forth the configuration of the present invention safety control responding to an over pressure or reflex grip actuation. Finally, FIG. 2D sets forth the release or return stroke of the present invention safety control following trigger release by the user.

More specifically, FIG. 2A sets forth the normal off position of the present invention safety control generally referenced by numeral 30. Control 30 includes an elongated trigger rod 31 movably supported within the interior of an otherwise conventional power tool such as circular saw 10. Trigger rod 31 is supported by conventional means (not shown) and is slidably movable in the direction indicated by arrow 22. Trigger rod 31 is secured to trigger 20 at one end and defines a recess 32 having a post 33 supported therein. Recess 32 further defines an edge 34 and an edge 35. Trigger rod 31 further defines an end portion 36 which is slidably received within a passage 51 defined in saw body 50. End 36 further defines an angled surface 37 and is secured to a coil spring 52. Coil spring 52 comprises a return spring and thus is compressively captivated between end 36 and the end portion of passage 51 and exerts a return force upon trigger rod 31 opposite to the direction indicated by arrow 22. Saw body 50 further defines a recess 55 beneath passage 51 within which a spring 56 is supported. A ball 57 is secured to the free end of spring 56 and extends into the travel path of trigger rod 31.

Control 30 further includes an elongated pawl 40 pivotally secured to post 33 and having a post 41 formed thereon. An additional post 42 extends outwardly from trigger rod 31 proximate edge 35. A spring 43 is received upon post 33 and includes resilient end portions extending to and secured upon posts 41 and 42. Spring 43 provides a restoring spring force operative upon pawl 40 to urge pawl 40 in a counterclockwise rotational direction. Thus, in the absence of forces upon pawl 40, spring 43 urges pawl 40 against edge 35 in the position shown in FIG. 2A.

An electrical push button switch 45 includes a depressible button 46 and a pivot 48. A movable switch lever 47 is pivotally secured to switch 45 at pivot 48. Switch 45 comprises a normally off electrical switch and thus, in the absence of a depressing force, button 46 is maintained in the off position extending downwardly in the manner shown in FIG. 2A.

In operation, with control 30 in the inoperative position shown in FIG. 2A, the force of spring 52 maintains the off position of trigger rod 31 and trigger 20. In this off position, the spring force of push button switch 45 urges button 46 outwardly against lever 47 resulting in an off or open circuit condition for switch 45.

As the user squeezes trigger 20 in the direction indicated by arrow 22, the force of spring 52 is overcome compressing spring 52 and moving trigger 20 and trigger rod 31 in the direction indicated by arrow 22. As trigger rod 31 moves in the direction indicated by arrow 22, pawl 40 is driven against lever 47 causing it to pivot upwardly in the direction indicated by arrow 23 which in turn depresses button 46 upwardly and actuates switch 45 producing a closed circuit condition which energizes the power tool. As the trigger force is maintained upon trigger 20, trigger rod 31 continues to move in the direction indicated by arrow 22 until angled surface 37 is brought into contact with ball 57.

FIG. 2B sets forth the resulting configuration of the present invention control in which angled surface 37 is contacted by ball 57 and further motion in the direction of arrow 22 is resisted by the force of spring 56. At this point, pawl 40 has pivoted lever 47 upwardly in the direction indicated by arrow 43 driving push button 46 upwardly in the direction indicated by arrow 24 and closing switch 45. This corresponds to the normal operation of the power tool and the user may then continue to operate the power tool by maintaining a sufficient force upon trigger 20 or may release trigger 20 to terminate the operation of the power tool. In the event the user releases trigger 20 from the position shown in FIG. 2B, spring 52 moves trigger rod 31 in the opposite direction of arrow 22 withdrawing pawl 40 from contact with level 47 and permitting switch 45 to again open to interrupt the energizing of the tool.

FIG. 2C sets forth the response of the present invention safety control in the event the user exercises an overgrip or reflex grip upon trigger 20. This excessive force or overgrip upon trigger 20 presumably occurring in response to a reflex action by the user in the manner described above is sufficient in force to overcome the resisting force of spring 56 and ball 57 against angled surface 37. As a result, spring 56 is overcome and compressed permitting ball 57 to move downwardly from angled surface 37 and thereafter to be locked against the underside of trigger rod 31. As trigger rod 31 moves further in the direction indicated by arrow 22 once the spring force of spring 56 is overcome, pawl 40 is moved beyond lever 47 releasing lever 47 and permitting switch 45 to return to the open circuit condition as lever 47 pivots downwardly in the direction indicated by arrow 25. In the position of FIG. 2C, as a result, switch 45 is open and the power tool is deenergized. Thus, no matter how much harder the user squeezes upon trigger 20, the deenergized condition of the power tool remains due to the open circuit condition of switch 45.

FIG. 2D sets forth the return stroke or resetting stroke of the present invention safety control following the user's release of trigger 20 from the safety shutoff position shown in FIG. 2C. In the absence of a force upon trigger 20, the return force of spring 52 moves trigger rod 31 outwardly in the direction indicated by arrow 26. As trigger rod 31 moves in the direction indicated by arrow 26, pawl 40 is driven against the end portion of lever 47. The pivotal attachment of pawl 40 permits pawl 40 to rotate in the clockwise direction overcoming the force of spring 43 and permitting pawl 40 to pass beneath the end portion of lever 47 without disturbing the position of push button 46. Thus, during the return stroke, switch 45 remains in the open circuit or off condition as trigger rod 31 and trigger 20 are restored to the normal off position. Concurrently, trigger rod 31 moves beyond ball 57 which then returns to the extended position shown in FIG. 2D. Once pawl 40 has passed beneath the end portion of lever 47, the restoring force of spring 43 pivots pawl 40 in the counterclockwise direction returning it to the upwardly extending position shown in FIG. 2A. At the end of the return stroke, control system 30 has returned to the configuration shown in FIG. 2A. Once this return stroke is complete, the subsequent depression of trigger 20 will again activate the power tool. However, in accordance with an important aspect of the present invention, it should be noted that switch 45 is placed in an open circuit off condition as the user reflex squeezes trigger 20 and moreover remains in an open circuit off condition despite the release of trigger 20 until the subsequent reset is complete and the user again depresses trigger 20. This operational characteristic provides a substantial benefit in the safe operation of the host power tool in that the oversqueezing or overgripping of the power tool handle and trigger depression that results therefrom result in interruption of the power tool operation which is maintained during the release and return stroke.

FIG. 3A through 3D set forth an alternate embodiment of the present invention safety control. Thus, by way of overview, FIG. 3A sets forth the present invention safety control in the normal off position while FIG. 3B sets forth the configuration of the present invention safety control in the normal on position. FIG. 3C sets forth the critical point of control operation in which the safety control is about to be tripped or turned off while FIG. 3D sets forth the tripped or off condition of the present invention safety control.

More specifically, FIG. 3A sets forth a partial section view of an alternate embodiment of the present invention safety control generally referenced by numeral 60. Control 60 includes a primary trigger 61 defining an interior cavity 63 and a spring catch 62. Spring catch 62 is preferably formed of a resilient material and further defines an angled surface 69 and an upwardly extending tab 68. Primary trigger 61 is pivotally secured to a pivot 65 and further includes an upwardly extending arm 64. A return spring 66 is coupled to arm 64 and a stationary or fixed post 59. Control 60 further includes a secondary trigger 70 pivotally coupled to pivot 65 and defining a downwardly extending tab 72. An elongated switch link 80 is slidably supported within the host power tool by conventional means (not shown). Switch link 80 is pivotally coupled to secondary trigger 70 by a pin 71. Switch link 80 further includes a tab 73 having a post 74 extending therefrom. A return spring 75 is coupled at one end to post 74 with the remaining end thereof coupled to a fixed post 76 formed within the host power tool. Spring 75 provides a return spring force and thus is stretched between posts 74 and 76. A pair of tabs 81 and 82 extend outwardly from switch link 80 and captivate a switch button 85 of slide switch 84 and a spring 83. Slide switch 84 is coupled to the host power tool and defines an open circuit condition when switch button 85 is positioned in the manner shown in FIG. 3A and a closed circuit or energized position when slide switch 85 is positioned as shown in FIG. 3B. A post 67 is positioned within the travel path of spring catch 62 and is fixedly supported within the host power tool.

In operation and in the absence of a trigger force upon primary trigger 61, return spring 66 provides a return force which pivots primary trigger 61 in the direction indicated by arrow 90 to reach its fully extended position. Concurrently, return spring 75 exerts a return force upon switch link 80 in the direction indicated by arrow 93 which moves switch button 85 of slide switch 84 to the open circuit position shown. Concurrently, the action of return spring 75 moving switch link 80 in the direction of arrow 93 also produces a pivotal force upon secondary trigger 70 in the direction indicated by arrow 95 bringing tab 72 thereof into contact with tab 68 of spring catch 62. Thus, in the configuration shown in FIG. 3A, slide switch 84 is off or open circuited and primary trigger 61 is positioned at its maximum pivotal extension.

FIG. 3B sets forth the configuration of control 60 as the user depresses primary trigger 61 in the direction indicated by arrow 91. The contact of tabs 68 and 72 of primary trigger 61 and secondary trigger 70 cause the pivotal motion of primary trigger 61 to produce a corresponding pivotal motion of secondary trigger 70 in the direction indicated by arrow 94. As secondary trigger 70 pivots in the direction indicated by arrow 94, switch link 80 is moved in the direction indicated by arrow 92 overcoming the spring force of spring 75. The motion of switch link 80 in the direction of arrow 92 carries switch button 85 of slide switch 84 upwardly to the closed circuit or activating position shown in FIG. 3B. This normal on or closed circuit position results in resting surface 69 of spring catch 62 against post 67. Thus, so long as the user maintains the force against primary trigger 61, switch 84 is maintained in the closed circuit position and the host power tool is activated. In the event the user releases primary trigger 61, the return force provided by spring 75 draws switch link 80 downwardly in the direction indicated by arrow 93 carrying switch button 85 to the off position shown in FIG. 3A. Concurrently, the downward movement of switch link 80 pivots secondary trigger 70 in the direction indicated by arrow 95 which due to the contact of tab 72 against tab 68 also pivots primary trigger 61 in the direction indicated by arrow 90. Thus, release of primary trigger 61 from the normal on position shown in FIG. 3B simply returns control 60 to the normal off position shown in FIG. 3A.

FIG. 3C sets forth the configuration of the present invention control as the user continues to oversqueeze or overgrip primary trigger 61 presumably under the influence of the above-described reflex action. As increased force is applied to primary trigger 61 in the direction indicated by arrow 91, surface 69 of spring catch 62 is forced against post 67 causing spring catch 62 to be flexed outwardly. If sufficient force is applied, spring catch 62 is flexed outwardly a sufficient distance to permit tab 72 to move past tab 68. Under these conditions, the spring force of return spring 75 is no longer resisted and switch link 80 is drawn downwardly in the direction indicated by arrow 93 causing secondary trigger 70 to be pivoted in the direction indicated by arrow 95. Because secondary trigger 70 is freely movable within cavity 63 of primary trigger 61, the pivotal motion of secondary trigger 70 within primary trigger 61 in the direction of arrow 95 continues notwithstanding the user's continued squeezing pressure against primary trigger 61.

FIG. 3D sets forth the fully tripped or off condition of the present invention safety control in which the user has maintained the locked or reflex grip upon primary trigger 61 and in which tab 72 of secondary trigger 70 has moved clear of tab 68 of primary trigger 61. As a result, return spring 75 has moved switch link 80 downwardly in the direction of arrow 93 and, as a result, switch button 85 has moved to the open circuit position causing slide switch 84 to be open circuited and deactivating the host power tool.

It should be noted that the open circuit condition of switch 84 is maintained despite the continued squeezing of primary trigger 61 by the user. Thus, the safety benefit has been achieved in which the continued squeezing of the primary trigger has resulted in shutting down the power tool and thereby injury is avoided. Once the user releases primary trigger 60, the restoring force of return spring 66 pivots primary trigger 61 in the direction indicated by arrow 90 returning primary trigger 61 to the off position shown in FIG. 3A without disturbing the off or open circuit condition of slide switch 84. It should be noted that as primary trigger 61 returns to its open circuit condition, the angled surfaces of tabs 72 and 68 together with the resilience of spring catch 62 permit spring catch 62 to flex and allow primary trigger 61 to move past secondary trigger 70 and reestablish the normal off or reset position shown in FIG. 3A. Thus, in accordance with an important aspect of the present invention, it should be noted that slide switch 84 remains in the off or open circuit condition during the return stroke or reset of control 60. This maintains the safety margin desired and contributes greatly to the safety provided by the present invention safety control. It should be noted that the cooperation of tabs 81 and 82 together with spring 83 provide a safety coupling between switch link 80 and switch button 85 in which slide switch 84 is protected against over travel of switch link 80.

FIG. 4 sets forth a perspective assembly view of safety control 60. As described above, primary trigger 61 defines an interior cavity 63, an upwardly extending arm 64 and a curved spring catch 62. The end portion of spring catch 62 defines a tab 68 and an angled surface 69. Arm 64 supports a post 77 while apertures 78 and 79 are formed in primary trigger 61 to receive a pivot pin 65. A return spring 66 is coupled between post 77 of arm 64 and a stationary post 59 (seen in FIG. 3). A secondary trigger 70 defines an interior cavity 85 and a downwardly extending tab 72. Secondary trigger 70 is receivable within cavity 63 of primary trigger 61. Secondary trigger 70 defines a pair of apertures 86 and 87 and a pair of apertures 96 and 97. Apertures 86 and 87 receive pivot 65 passing through apertures 78 and 79 of primary trigger 61 to provide the above-described pivotal attachment between primary trigger 61 and secondary trigger 70.

An elongated switch link 80 defines an aperture 88 at one end and a pair of spaced apart tabs 81 and 82 at the remaining end. Slide switch 84 which provides the power coupling of the host tool using the present invention control system includes a movable slide button 85 which is received between tabs 81 and 82 and secured therein by a coil spring 83. Switch link 80 further includes a tab 73 defining a post 74. As described above, switch link 80 is slidably movable by means not shown within the host power tool such that the end portion of switch link 80 is received within cavity 85 of secondary trigger 70 after which pin 71 is passed through apertures 96 and 97 and aperture 88 to pivotally secure switch link 80 to secondary trigger 70. A return spring 75 is coupled to post 74 and a fixed post 76 (seen in FIG. 3).

Figure 5:
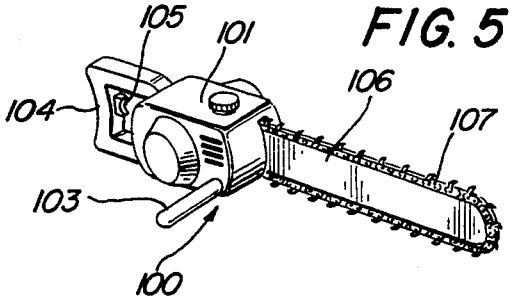
FIG. 5 sets forth a perspective view of a gasoline powered chain saw having a safety control constructed in accordance with the present invention.

FIG. 5 sets forth a perspective view of a gasoline powered chain saw having a safety control constructed in accordance with an alternate embodiment of the present invention and generally referenced by numeral 100. Chain saw 100 includes a housing 101 supporting a small compact gasoline engine 102. A chain guide 106 is secured to the frontal portion of housing 101 and supports a closed loop cutting change 107. By operative means not shown in FIG. 5 but in accordance with conventional fabrication techniques, engine 102 is coupled to chain 107 to provide operative power to move cutting chain 107. Housing 11 further includes a rearwardly extending handle 104 supporting a movable trigger control 105. The handle 103 extends outwardly from handle 107.

In normal operation, the user grasps handle 104 such that at least one finger overlies trigger control 105 within one hand while grasping handle 103 with the remaining hand. Thereafter, engine 102 is started and is controlled by operative coupling between trigger 105 and the throttle control of engine 102 (seen in FIGS. 6A through 6C). The user's grip upon handle 103 operate solely to manipulate and control the attitude and position of chain saw 100. In normal use, the user is able to depress trigger control 105 in proportion to the speed desired for cutting chain 107. Thus, a slight pressure on trigger 105 produces a slow speed travel for cutting chain 107 while a greater depression of trigger 105 produces a greater speed of cutting chain 107. Thus, trigger 105 is, in effect, an accelerator or throttle control element for controlling the speed of engine 102. Under normal circumstances, the user is able is adjust the speed of chain 107 as desired using trigger 105. Under precarious conditions of operation, such as reaching high overhead or other safety compromising uses of chain saw 100, the user is apt to rely much more heavily upon the grip employed for handle 104 and, in the event something goes wrong, much more likely to indulge in the reflex grasp of handle 104 and trigger 105 described above. As is the case with electrically powered tools, gasoline engine powered tools such as chain saw 100, but for the present invention, create the same type of hazard when grasped in this locked reflex grip depressing trigger 105 fully and running engine 102 and chain 107 to maximum speed thereby increasing the danger to the operator or user.

In accordance with the present invention ,the safety control (seen in FIGS. 6 and 7) responds to the reflex locking grip upon trigger 105 and turns off engine 102. In further accordance with the present invention and in the manner set forth below in greater detail, the release of trigger 105 following the safety shutdown of engine 102 does not reactivate engine 102. Thus, trigger 105 following emergency shutdown must be returned to the full off position and reset before the engine driving cutting chain 107 may again be activated. It will be apparent to those skilled in the art that while a gasoline powered chain saw is shown by way of example in FIG. 5, the present invention safety control is equally applicable to virtually any power tool utilizing a small engine power source.

Figure 6A:
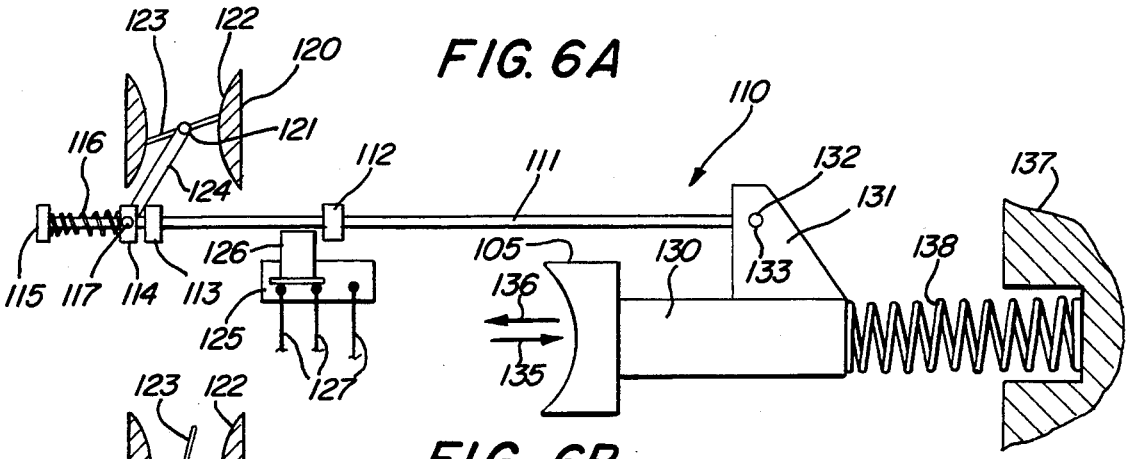
FIGS. 6A through 6C taken together set forth the operational sequence of the present invention safety control of FIG. 5.
Figure 6B:
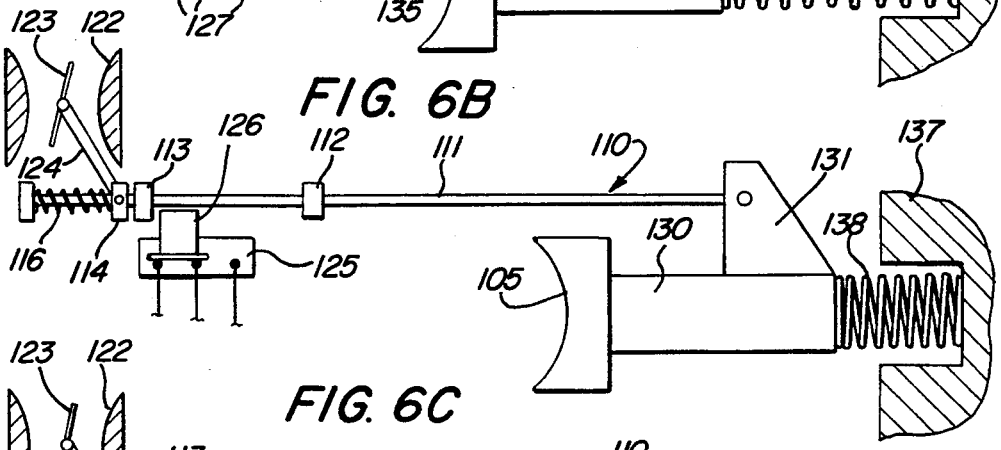
Figure 6C:
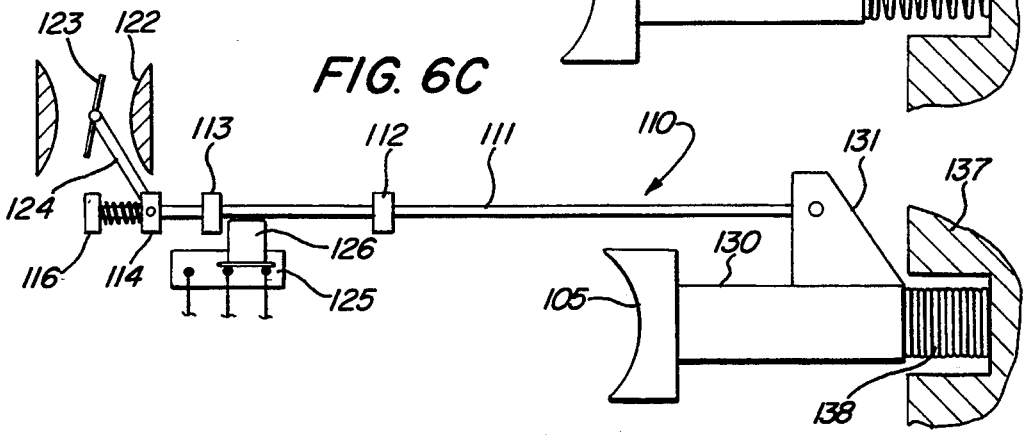

FIGS. 6A through 6C set forth a diagrammatic representation of the present invention safety control generally referenced by numeral 110 and used to control an engine driven power tool. By way of overview, FIG. 6A shows the configuration of safety control 110 in the normal off position while FIG. 6B shows the configuration of safety control 110 in the normal on position corresponding to full throttle. FIG. 6C sets forth the configuration of safety control 110 following a safety shutdown due to over travel of the trigger control.

More specifically, FIG. 6A sets forth safety control 110 in the normal off condition and in the absence of any trigger force upon trigger 105. In accordance with conventional fabrication techniques, engine 102 (seen in FIG. 1) includes a carburetor throat portion 120 which should be understood to form a portion of a complete carburetor which need not be shown for purposes of illustrating the present invention safety control. In further accordance with conventional fabrication techniques, carburetor throat 120 defines a narrowed venturi portion 122 within which a shaft 121 pivotally supports a throttle plate 123. In accordance with conventional motor control operation, the angular position of throttle plate 123 controls the flow of air fuel mixture through venturi area 122 and thereby controls the speed of engine 102. A throttle link 124 is coupled to shaft 121 and operates to control the angular position of throttle plate 123.

An elongated shaft 111 is slidably supported by conventional support means not shown and includes a fixed collar 115 at one end thereof. Shaft 111 further supports a fixed collar 112, a fixed collar 113 and a movable collar 114. The latter is coupled to throttle link 124 by a pin 117. An over travel spring 116 is interposed between movable collar 114 and fixed collar 115. A safety switch 125 includes a slide 126 interposed between fixed collars 112 and 113. Switch 125 further includes a plurality of connecting wires 127 which are coupled to the ignition system (not shown) of engine 102 in a manner which either facilitates normal operation of engine 102 (the position shown in FIGS. 6A and 6B) or, alternatively, shuts engine 102 down completely (the position shown in FIG. 6C).

A trigger 105 is slidably supported by means not shown and includes a trigger slide 130 extending inwardly from trigger 105. Trigger slide 130 includes a flange 131 having an aperture 132 defined therein. Shaft 111 terminates in a pin 133 which is received within aperture 132 and which couples shaft 111 to flange 131. A spring 138 is captivated between a fixed housing 137 and the interior end of trigger slide 130. Spring 138 comprises a return spring which produces a spring force urging trigger slide 130 outwardly in the direction indicated by arrow 136.

In operation, the user starts engine 102 in accordance with normal starting techniques and, in most instances in the relaxed position shown in FIG. 6A, the engine tends to idle or run at extremely slow speeds in the absence of movement of throttle plate 123. Once the engine is running, the user increases engine speed by depressing trigger 105 inwardly in the direction indicated by arrow 135. This trigger movement in turn moves trigger slide 130, flange 131 and draws shaft 111 in the direction indicated by arrow 135. This motion is communicated to throttle link 124 by the cooperation of movable collar 114, spring 116 and fixed collar 115 causing pivotal movement of throttle link 124 and throttle plate 123 in a counterclockwise direction about shaft 121. This corresponds to an opening motion clearing venturi 122 and permitting engine 102 to increase speed. Upon the release of trigger 105, return spring 138 moves slide 130 and shaft 111 in the direction indicated by arrow 136 which permits throttle link 124 and throttle plate 123 to return to the closed position shown.

FIG. 6B sets forth the normal operating position at relatively high speed in which the control system responds to substantial depression of trigger 105. As can be seen, this normal operating position is achieved by the user having displaced trigger 105 in the direction indicated by arrow 135 a substantial trigger 105 in the direction indicated by arrow 135 a substantial distance compressing spring 138. A corresponding linear motion is imparted to shaft 111 causing movable collar 114 to pivot throttle link 124 and open throttle plate 123. It should be noted that during the normal operative range of positions for safety control 110 shown in FIGS. 6A and 6B, the on position of safety switch 125 is not disturbed and slide 126 remains in the on position.

FIG. 6C sets forth the configuration of safety control 110 operative to shutdown the running of engine 102 due to an overgrip or reflex grip upon trigger 105 such as would occur during the above-described reflex action. As can be seen, the excess force exerted upon trigger 105 in the direction indicated by arrow 135 as the user more tightly grips handle 104 (seen in FIG. 5) overcomes the combined spring forces of spring 138 and 116 moving trigger 105 and shaft 111 maximally inwardly in the direction of arrow 135. The resulting movement of shaft 111 draws fixed collar 113 against slide 126 moving slide 126 to the off position shown in FIG. 6C and shutting down the operation of the chain saw engine. Concurrently, spring 116 is compressed and thus permits control 110 to tolerate the over travel of shaft 111 occurring during the safety shutdown procedure. It should be noted that in accordance with an important aspect of the present invention safety control, the shutdown of the power tool engine is maintained notwithstanding substantial duration of force of trigger 105. Also, it should be noted that the release of trigger 105 does not restart the engine. More specifically, once the operator releases trigger 105 from the reflex grip, the return force of spring 138 moves trigger slide 130 and shaft 111 outwardly in the direction indicated by arrow 136. As shaft 111 returns to the position shown in FIG. 6A, fixed collar 112 moves slide 126 back to the on position shown in FIG. 6A while throttle link 124 and throttle plate 123 are pivoted in the clockwise direction to reassume the closed position. It should be understood by those skilled in the art that once safety switch 125 has shutdown the power tool engine, the return of safety switch 125 to the on position does not of itself restart the engine.

It will be apparent to those skilled in the art that FIGS. 6A through 6C are diagrammatic representations and somewhat simplified to facilitate explanation of system operation. It will be recognized that a variety of differing configurations may be used to provide the same operation within the constrictions of handle shape and housing shape afforded in a typical engine-driven power tool. For example, shaft 111 may be replaced by a small coaxial cable thereby affording substantial freedom in the physical placement of the system components without departing from the spirit and scope of the present invention.

Figure 7:
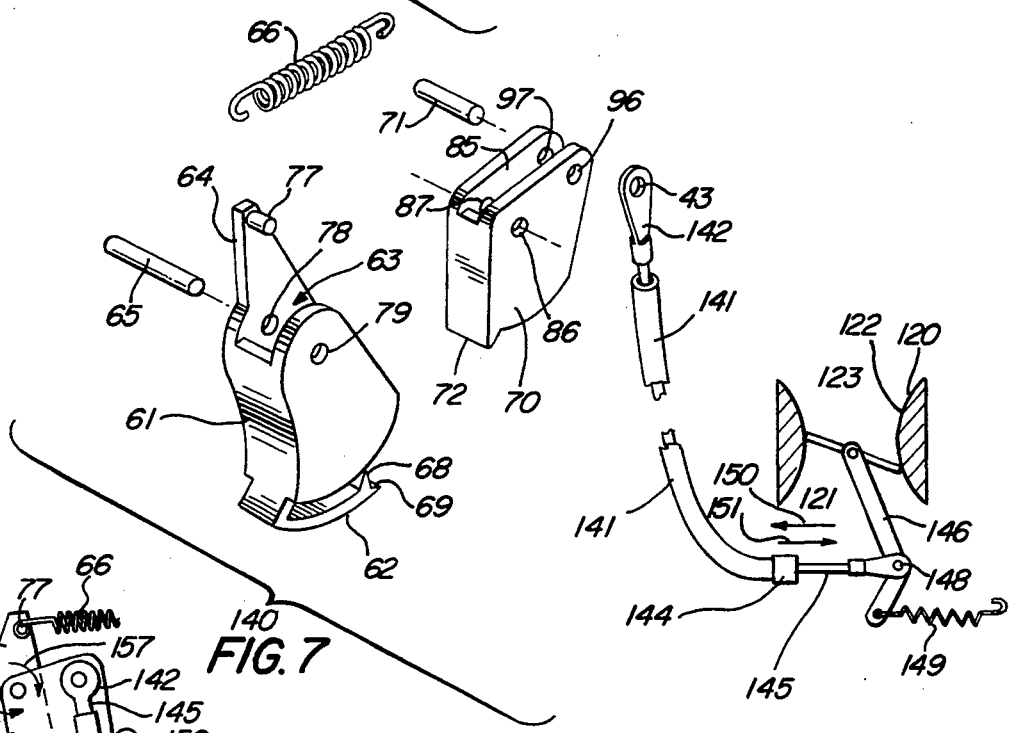
FIG. 7 sets forth a perspective assembly view of an alternate embodiment of the present invention safety control for use in gasoline powered tools such as the chain saw shown in FIG. 5.

FIG. 7 sets forth a perspective view of an alternate embodiment of the present invention safety control generally referenced by numeral 140. Safety control 140 utilizes a primary trigger 61 and a secondary trigger 70 together with a return spring 66 configured in the manner set forth above in the embodiment of FIG. 4. Thus, primary trigger 61 defines an interior cavity 63, a pair of apertures 78 and 79, an upwardly extending arm 64 having a post 77 and a resilient spring catch 62. Spring catch 62 defines an angled surface 69 and a tab 68. Similarly, secondary trigger 70 defines an interior cavity 85, a pair of apertures 86 and 87 and a pair of apertures 96 and 97. Secondary trigger 70 further defines a tab 72 and is received within cavity 63 of primary trigger 61 and secured pivotally therein by a pin 65. Return spring 66 is coupled between post 77 and a fixed attachment point (not shown).

Thus, it should be understood that primary trigger 61 and secondary trigger 70 function in the manner set forth above in FIGS. 3 and 4 and thus it will be apparent that primary trigger 61 and secondary trigger 70 are capable of use with a variety of safety control embodiments. For purposes of illustration, safety control 140 is shown in FIG. 7 to operate a small engine powered tool and thus FIG. 7 sets forth a carburetor throat 120 and a venturi 122 forming portions of a typical small gasoline engine of the type used to power engine driven tools. Similarly, a shaft 121 is positioned within venturi 122 and pivotally supports throttle plate 123. A linkage arm 146 is coupled to shaft 121 at one end and is coupled to a return spring 149 at the lower end. To facilitate coupling between linkage arm 146 and secondary trigger 70, an elongated cable 141 constructed in accordance with conventional throttle cable type fabrications includes a fixed or stationary outer tube 144 having a movable flexible shaft 145 therein. A connector 142 having an aperture 143 is secured to one end of flexible shaft 145 and is further secured to secondary trigger 70 by pin 71 passing through apertures 96, 97 and 143. The remaining end of flexible shaft 145 is coupled to linkage arm 146 by a pin 148.

It will be apparent to those skilled in the art that primary trigger 61 and secondary trigger 70 may be operated in combination with limit post 67 in which connector 142 of cable 141 is coupled to secondary trigger 70. In such event, flexible shaft 145 within cable 141 is moved by the pivotal motion of secondary trigger 70 in the manner described above in FIGS. 3 and 4. However, for purposes of further illustration, safety control 140 utilizes an alternative stationary pin or limit stop arrangement shown in FIG. 8.

Figure 8:
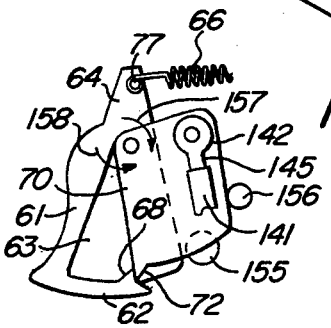
FIG. 8 sets forth a partial section view of an alternate embodiment of the present invention safety control.

With reference to FIG. 8, primary trigger 61 and secondary trigger 70 are shown pivotally secured by pin 65 in the manner described above. Likewise, in similarity to the manner described above, spring 66 is coupled to post 77 of arm 64 to provide a return spring force. Cable 141 is coupled to secondary trigger 70 and to throttle shaft 146. Thus, as the user squeezes primary trigger 61, trigger 61 is pivoted in the direction indicated by arrow 158. The contact of tabs 68 and 72 causes the motion of primary trigger 61 to be imparted to secondary trigger 70 which in turn draws flexible shaft 145 of cable 141 upwardly overcoming the return force of spring 149. This pivotal motion of primary trigger 61 and secondary trigger 70 continues until secondary trigger abuts 70 stationary limit pin 156. It should be noted that at the point of travel at which secondary trigger 70 contacts limit pin 156, primary trigger 61 has not yet contacted limit pin 155. This position show in FIG. 8 corresponds to the normal full throttle position of safety control 140. In the event the operator releases trigger 61, the return spring forces of springs 66 and 149 pivots primary trigger 61 and secondary trigger 70 outwardly in the direction indicated by arrow 157.

In the event, however, the user squeezes harder upon primary trigger 61 presumably during the above-described reflex gripping action, additional force is applied to secondary trigger 70 which is precluded from further movement by pin 156. However, primary trigger 61 having not yet reached its limit position in contact with pin 155 is opposed solely by the interaction of tabs 68 and 72. Since spring catch 62 supporting tab 68 is somewhat resilient, the additional force applied to primary trigger 61 causes spring catch 62 to flex outwardly thereby permitting tab 68 to clear tab 72 and releasing the coupling between primary trigger 61 and secondary trigger 70. Once tabs 68 and 72 clear, primary trigger 70 is returned to its off position pivoting in the direction indicated by arrow 157 within recess 63 due to the return spring force of spring 149. The remainder of operation of primary trigger 61 and secondary trigger 70 functions in accordance with that set forth above in that the release of primary trigger 61 permits return spring 66 to pivot primary trigger 61 in the direction of arrow 157 wherein the angled surfaces of tab 68 and 72 facilitate the flexing of spring catch 62 and permit tab 68 to move past tab 72 allowing primary trigger 61 to be reset to the position shown in FIG. 8.

It should be noted that the embodiment of the present invention safety control set forth in FIG. 7 is particularly well suited to small engine driven power tools in which a speed energized clutch or centrifugal clutch is used between the engine an the power cutting apparatus. As such, the system returns to an engine idle position and avoids the need for a shutoff switch as set forth above.

What has been shown is a safety control for power tool having a trigger actuator in which the safety control responds to one degree of trigger movement to activate or turn on the power tool and which responds to a further degree of movement by the trigger to transition the power control to an off condition and to reset the power control to a normal off position following release of the trigger without transitioning through an energized or on state. In one embodiment shown, a primary trigger and secondary trigger are pivotally coupled to the power tool control apparatus and engage and disengage to provide the secondary control function. In other embodiments, a movable pawl is supported by the trigger and is operated in one direction of trigger motion to shutdown the tool operation and in the other direction to reset the power tool without transitioning through an on state.

That which is claimed is:

1. For use in controlling a power tool having drive means and a pivotally supported depressible trigger control member pivotably movable in a first direction between an angular off position, and an angular on position to activate said power tool and pivotable in a second direction between the on position and off position to deactivate said power tool, a safety control comprising:

first means for responding to control member pivotal movement in said first direction beyond said angular on position to an angular shutdown position to deactivate said power tool including resistance means operative upon said control member proximate said on position to resist further motion of said control member beyond said on position;

second means responsive to control member movement in said second direction from said angular shutdown position to said angular off position for maintaining the deactivation of said power tool notwithstanding control member movement through said angular on position; and a secondary trigger pivotally supported with respect to said depressible trigger, said resistance means including a spring catch supported upon said depressible trigger engaging said secondary trigger during movement in said first direction from said off position to said on position and disengaging said secondary trigger during movement of said depressible trigger in said first direction beyond said on position, said secondary trigger being operatively coupled to said drive means.

2. A safety control as set forth in claim 1 wherein said spring catch includes:

a first tab supported upon said depressible trigger;

a second tab supported upon said secondary trigger within the travel path of said first tab; and a tab spring for releasing said first and second tabs from engagement.

3. A safety control as set forth in claim 2 wherein said tab spring includes a resilient member supporting said first tab.

4. A safety control as set forth in claim 3 wherein said depressible trigger defines an interior cavity and wherein said secondary trigger is partially received within said interior cavity.

5. For use in controlling a power tool having drive means, a safety control comprising:

a switch movable between an on position activating said drive means and an off position deactivating said drive means;

a secondary trigger pivotable in a first direction to move said switch to said on position and a second direction to move said switch to said off position;

a primary trigger pivotable in said first direction to pivot said secondary trigger in said first direction;

release means coupled between said primary and secondary triggers operative to release said secondary trigger from said primary trigger in response to increased force in said first direction once said primary trigger has moved said secondary trigger in said first direction and moved said switch to said on position; and spring means urging said secondary trigger in said second direction, said secondary trigger pivoting in said second direction following release from said primary trigger to move said switch to said off position.

* * * * *